US005383837A

United States Patent [19]

Watts

[11] Patent Number: 5,383,837

[45] Date of Patent: Jan. 24, 1995

[54] METHOD AND APPARATUS FOR MAKING IMPROVED DUNNAGE

[75] Inventor: Ridley Watts, Gates Mills, Ohio

[73] Assignee: Patriot Packaging Corporation, Cleveland, Ohio

[21] Appl. No.: 55,861

[22] Filed: Apr. 30, 1993

Related U.S. Application Data

[63] Continuation-in-part of Ser. No. 861,247, Mar. 31, 1992, Pat. No. 5,257,492, which is a continuation-in-part of Ser. No. 681,087, Apr. 5, 1991, Pat. No. 5,181,614.

[51] Int. Cl.[6] ..... B31F 1/00; B31F 1/14; B65B 23/00

[52] U.S. Cl. ..... 493/352; 493/459; 493/967

[58] Field of Search ..... 493/352, 353, 354, 361, 493/362, 363, 370, 459, 967

[56] References Cited

U.S. PATENT DOCUMENTS

| | | |
|---|---|---|
| 390,442 | 10/1888 | Brigham . |
| 425,042 | 4/1890 | Moseley et al. . |
| 727,055 | 5/1903 | Arnold . |
| 2,297,368 | 9/1942 | Rippl et al. . |
| 2,924,154 | 2/1960 | Russell et al. . |
| 3,047,136 | 7/1962 | Graham . |
| 3,074,543 | 1/1963 | Stanley . |
| 3,347,036 | 10/1967 | Daniel . |
| 3,347,136 | 10/1967 | Kure . |
| 3,481,455 | 12/1969 | Graham et al. . |
| 3,650,877 | 3/1972 | Johnson . |
| 3,655,500 | 4/1972 | Johnson . |
| 3,723,240 | 3/1973 | Skochdopole et al. . |
| 3,852,152 | 12/1974 | Werner et al. . |
| 4,005,569 | 2/1977 | Corbiere . |
| 4,042,658 | 8/1977 | Collins . |
| 4,247,289 | 1/1981 | McCabe . |
| 4,800,708 | 1/1989 | Sperry . |
| 5,088,972 | 2/1992 | Parker . |
| 5,120,296 | 6/1992 | Yamaguchi et al. ..... 493/352 |

FOREIGN PATENT DOCUMENTS

| | | |
|---|---|---|
| 747107 | 11/1966 | Canada . |

*Primary Examiner*—William E. Terrell

*Attorney, Agent, or Firm*—Watts, Hoffmann, Fisher & Heinke Co.

[57] ABSTRACT

Apparatus and methods for making improved dunnage from a length of flexible material, such as paper. Strips are formed from the material and modified to form spiral coils by feeding the strips between a fixed rigid forming blade and a rotated roller having a resilient surface. The roller carries peripherally spaced cutting blades that act against the forming blade to periodically sever coiled portions of the strips. The coils are preferably then creased between their ends and are randomly oriented in a container to provide cushioning for packaged articles. The coils are formed at the time of use by the apparatus and methods disclosed.

17 Claims, 10 Drawing Sheets

METHOD AND APPARATUS FOR MAKING IMPROVED DUNNAGE

RELATED APPLICATION

This application is a continuation-in-part of copending application Ser. No. 07/861,247 filed Mar. 31, 1992, now U.S. Pat. No. 5,257,492, which is a continuation-in-part of application Ser. No. 07/681,087, filed Apr. 5, 1991, now U.S. Pat. No. 5,181,614.

FIELD OF INVENTION

This invention relates to apparatus and methods for making spiral coils for use as improved dunnage for protecting packaged articles.

BACKGROUND OF INVENTION

It is common to protect articles being shipped in containers by filling extra space in the container with so called dunnage to isolate the articles from the container walls and inhibit movement of the articles within the container. Retailers, and especially those who specialize in catalog sales, typically use boxes that are not specifically designed in size or shape for particular articles and therefore they include substantial amounts of packing or dunnage in the boxes along with the article or articles shipped to reduce the risk of breakage.

SUMMARY OF THE INVENTION

It has been found that paper strips can be spirally coiled to form improved dunnage that has the advantages of being made at the packaging site from large paper rolls that occupy little space, that can be recycled paper, and the dunnage can be disposed of in an ecologically sound manner because it is biodegradable.

The present invention provides methods and apparatus that allow a user to overcome the storage problem, the disposal problem and the difficulties in packing with other materials, such as shredded material. It provides low cost, small size, dunnage that can be formed and directly dispensed into packages by the retailer. In its preferred form, the dunnage itself is recycled material, can again be recycled, and is biodegradable. It is extremely compact before being formed and after use it can be compressed in volume to a small fraction of its volume as used.

The dunnage is small, resilient, spiral coils of thin, flexible, resilient strips, most advantageously paper strips, randomly oriented in a container to fill unused space, retard relative movement of an article within the container, and typically also at least in part to isolate the article from the container walls and thereby cushion fragile articles against shock.

Convolutions of the strips forming the coils are preferably closely adjacent one to the next and provide rigidity in the axial direction, and they surround an open central area that facilitates transverse distortion, but with resilience due to the inherent properties of the paper. Optionally, a transverse fold can be formed in the coil, either perpendicular to the coil axis or at an angle to the axis, to reduce axial rigidity and to vary the manner in which the randomly oriented coils interrelate. A variety of the shapes can be used together in a single package, which variety as well as the proportions of the different constructions used varies the cushioning characteristics of the dunnage.

The preferred manner of forming the coils is to cut a length of paper into strips, modify the paper in a manner to cause it to coil, then separate the coils from the strips, and thereafter, if desired, crease the coils transversely. Most advantageously, one side of the paper is stretched to cause it to coil.

Apparatus is provided for modifying the paper by stretching one side of the paper by bending it across a rigid edge, applying force and moving the paper across the edge. Advantageously, the paper is initially in the form of a rolled web and is slit in its direction of travel by rotary cutters, continuously fed and stretched across a narrow rigid edge, and cut transversely to desired length by a blade so as to fall directly into a shipping carton on a platform or conveyor below the shear, thereby avoiding any need for storing the formed dunnage. Preferably, the coils are positively moved into a creasing or folding mechanism to provide a transverse crease or fold in each coil.

Hard wound rolls of kraft paper store in a fraction (estimated to be about 1/30th, depending upon the density of the coils) of the space that would be required for styrene dunnage needed to fill the same capacity as the spiral coils made from the roll. By controlling the degree to which the paper coils, as by selecting the force applied against the edge across which the web is drawn, which regulates the diameter of the coils, and by varying the length of the strips that form each coil, the softness or firmness of the coils and the bulk density can be changed to suit the needs of the articles being packaged. The number of cutting cycles performed can be easily coordinated with step-by-step advance of a conveyor moving cartons beneath the coil-forming machine to control the amount of dunnage dispensed into each carton, allowing a mix of carton sizes to be handled through pre-programmed control of the conveyor feed.

In its broader aspects, the present invention relates to methods for concurrently forming a plurality of coils of thin, flexible, resilient strips, and this is accomplished by concurrently forming a plurality of spiral coils of paper having plural convolutions through steps that include providing a length of paper wider than the width of individual coils to be formed, continuously cutting the length of paper along the direction of feed to form adjacent strips, continuously moving the paper across a single narrow, rigid, surface with a driven roller having a resilient surface, bending and tensioning the length of paper across said surface with sufficient force to cause the length of paper to coil in a single direction into multiple convolutions, and periodically cutting the length of paper across its width by carrying a blade with said roller and moving the blade across said surface to pinch the paper between said surface and said blade. Advantageously, the coils are also creased transversely between their ends.

The invention also relates to apparatus for concurrently forming a plurality of coils of thin, flexible, resilient strips of material, the apparatus having structure defining a path along which a length of thin, flexible resilient material wider than individual coils to be formed is moved; cutters in said path for separating the length into strips that will form separate coils; a cylindrical roller rotatably supported across said path and having a resilient peripheral surface over which said material is moved; a stationary, rigid, member having a convex and narrow edge supported across said path, located to act against said material and said roller with force sufficient to indent the roller surface, for bending and tensioning said material across said edge; said edge having a lower coefficient of friction than said surface; a cutting element partially recessed in and extending along the width of the roller and across said path, and partially exposed at the peripheral surface of the roller, constructed and arranged to coact with said member to sever said material in a direction transverse to said path; and a drive for rotating said roller about a central axis relative to said member to feed said material past said edge.

BRIEF DESCRIPTION OF THE DRAWINGS

A preferred embodiment of the invention is shown in the accompanying drawings, in which.

DESCRIPTION OF PREFERRED EMBODIMENTS

Figure 2:
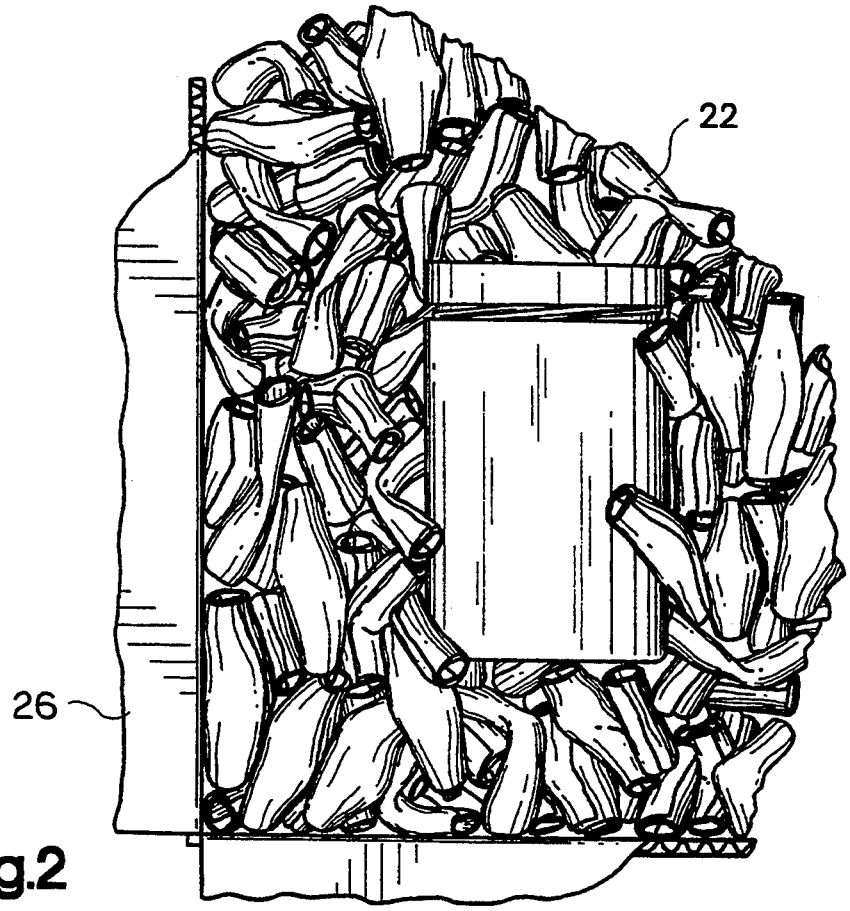
FIG. 2 is a partial top view of a partially filled, open package, diagrammatically indicating the manner in which spiral coils are randomly contained to protect a fragile article in a container.

With reference to the drawings, a machine 20 is shown for forming creased spiral coils 22 from a web 24 of paper preferably supplied from a roll 25 and for depositing the coils directly into an open box 26 on a support 28 beneath the machine. The support 28 in the embodiment shown accommodates the sliding of the box to proper position. Typically, where random sized boxes are being used and the articles being packaged are fragile, an operator will dispense a layer of dunnage in the form of the coils, place an article or articles in the box, and then fill the remaining volume with additional dunnage, thereby isolating the packaged article from the walls of the box, as diagrammatically illustrated in FIG. 2. The forming and dispensing of the coils is advantageously controlled by a foot switch (not shown). For applications where continuous packaging of similar items in boxes of uniform size is desired, two machines 20 can be used in tandem and the support 28 can be in the form of a conveyor, moving the boxes to a first machine that dispenses a layer of coils, then to a station between the two machines where an article or articles are placed in the box, and then to the second machine where the box is filled with coils. In that type of operation, the machines can be set to automatically form and dispense a predetermined quantity of coils each time a container is detected at the machine station. Because the coils are formed as they are used, no storage of bulky dunnage is required.

The coils 22 (FIGS. 2 and 16) are each formed of a strip 34 of paper (FIGS. 4 and 5) convolutely coiled into a spiral. Preferably, convolutions C of a strip are closely adjacent one to the next and a central area A surrounded by the convolutions is large in the transverse direction relative to the thickness of a ring R formed by the convolutions C. The thickness of the ring is sufficient to provide substantial axial strength or rigidity to the coil, while the inherent flexibility of the paper, along with the thickness of the ring and the relatively large central area A provides transverse resilience and "give," so that together those properties along with the random orientation of the coils in a container provide good isolation and cushioning of packaged articles. A preferred spiral coil 22 is made of a strip of 30 to 100 pound basis weight kraft paper (virgin, recycled, or a combination), about $1\frac{3}{4}$ inches wide and about 2 to 5 inches long. The outside diameter of the coil can be varied between about 3/16 and $\frac{3}{4}$ inch. Coils of these dimensions are useful for protecting articles having a large variation in size and weight. Of course, greater stiffness and larger coils can be achieved if necessary by using heavier paper, longer and wider strips and controlling the outside diameter by varying the extent to which the paper is modified to cause it to coil, or conversely, softer and smaller coils can be achieved in the opposite manner.

Figure 16:
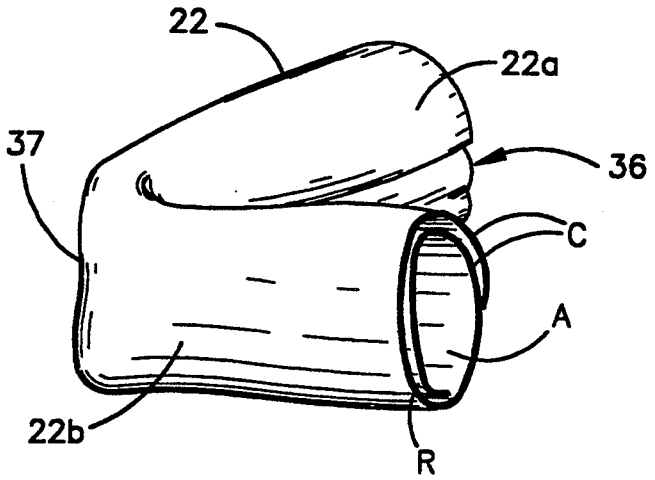
FIG. 16 is a perspective view of a creased spiral coil as formed by the apparatus of FIGS. 1 and 3–15.
Figure 7:
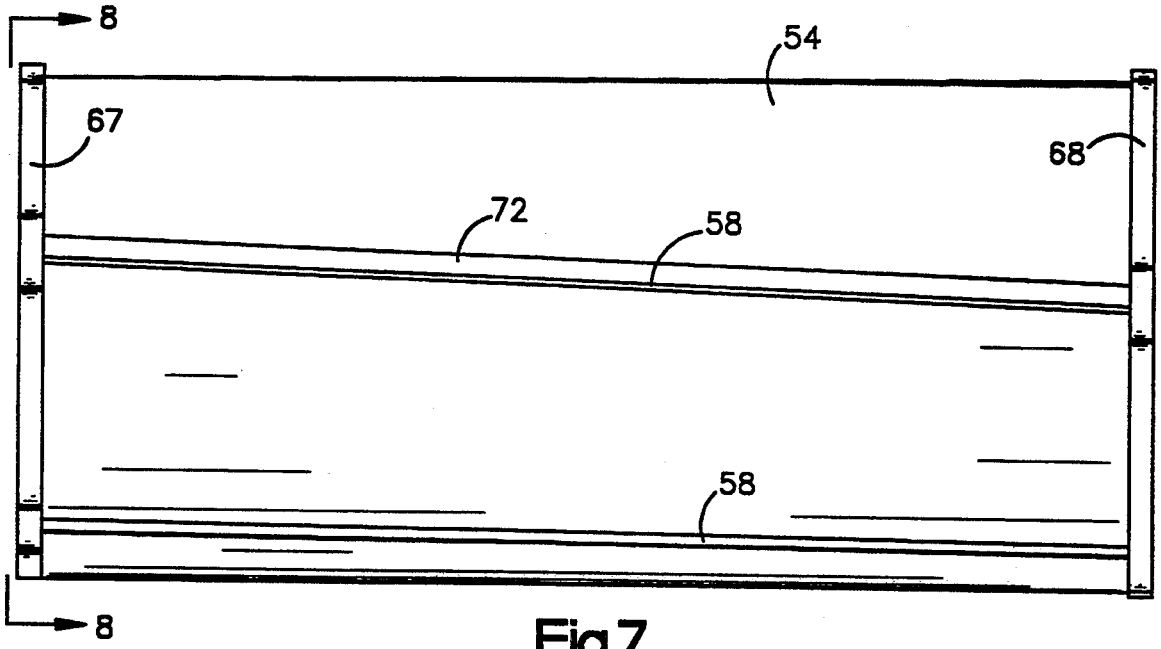
FIG. 7 is front elevational view of a cylindrical forming roller of the apparatus.

In accordance with the invention, preferably a fold or crease 37 is formed in each coil centrally of the ends, transversely of the coil axis, resulting in a bent shape as shown in FIG. 16. The crease 37 is substantially perpendicular to the coil axis and results in two portions **22*a* and 22*b* being angularly related in a common plane to which the crease is perpendicular. As a result of the crease, the area within the ring of convolutions varies axially of the coil, being substantially eliminated at the crease and being at a maximum and substantially circular in shape at the ends. The crease 37 tends to retain the coils in the formed configuration and the two angularly relate portions 22*a*, 22*b***, which, when compressed toward each other not only provide give and resilience through distortion of the cross sectional shape, but also through changes in the angle between the two angularly related portions.

Figure 1:
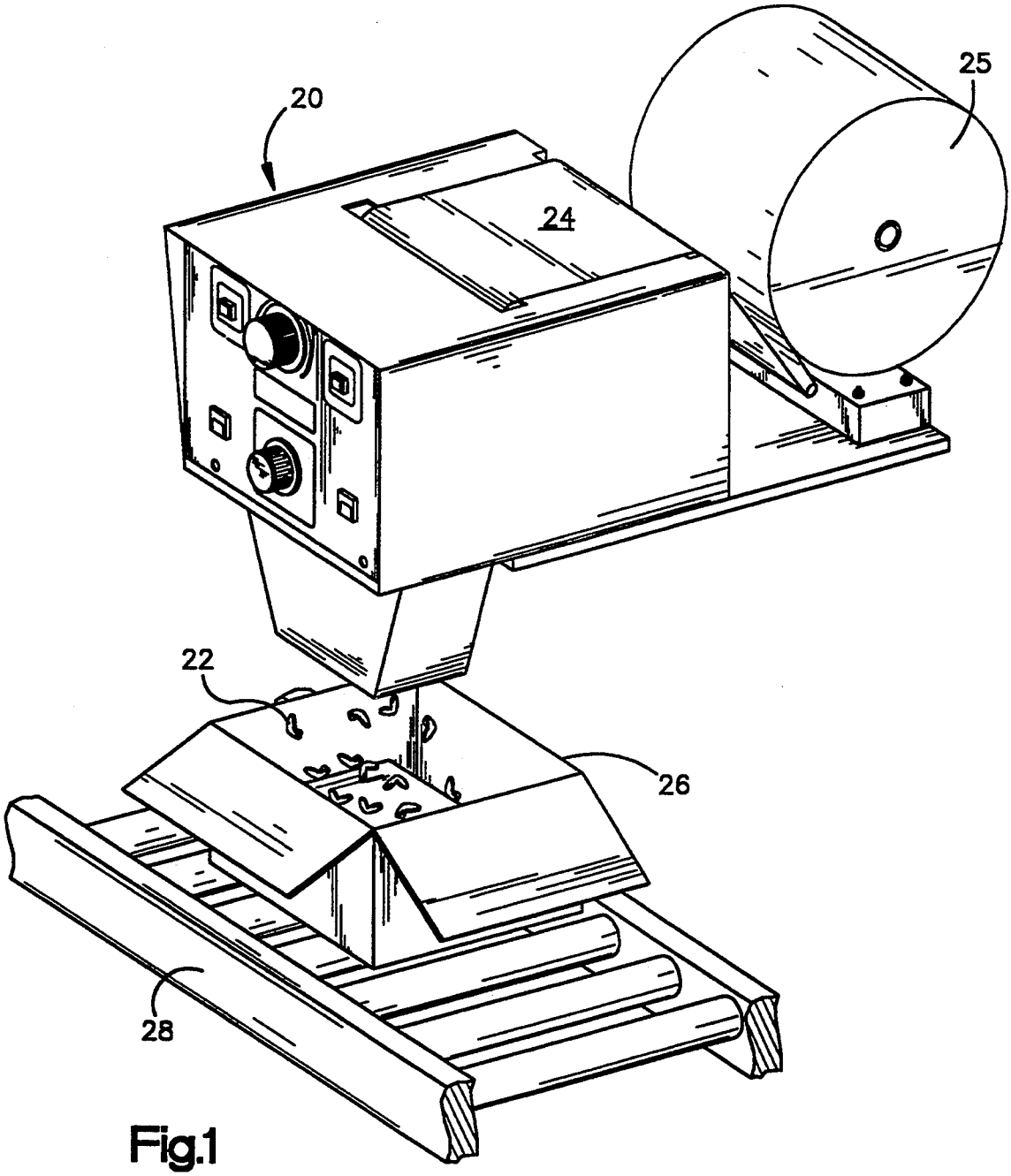
FIG. 1 is a perspective view of apparatus for forming and dispensing spiral coils for use as dunnage, in accordance with the present invention.
Figure 5:
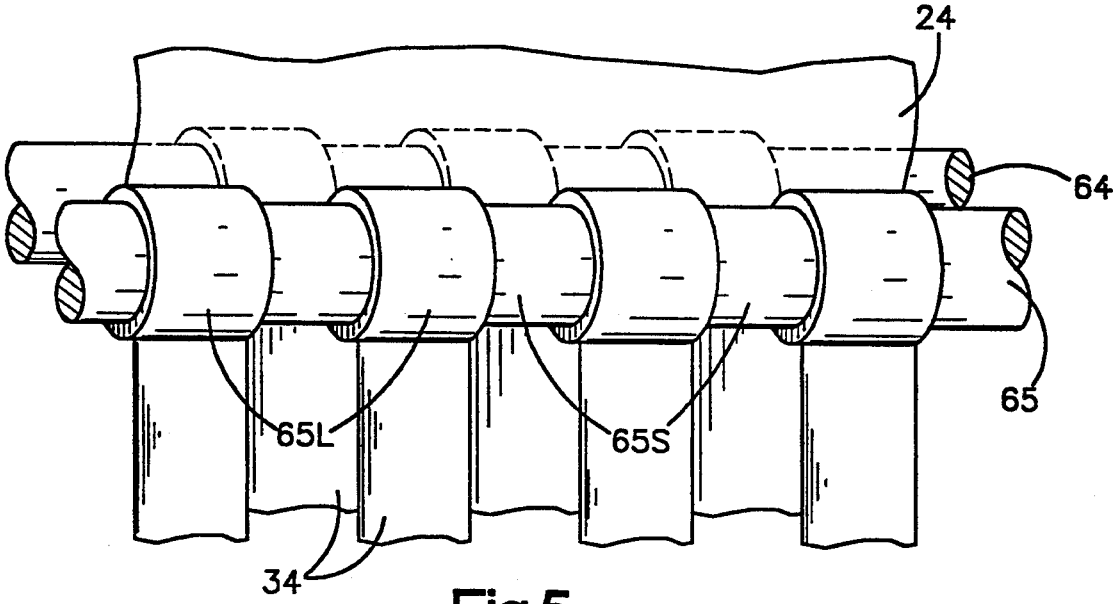
FIG. 5 is a partial perspective view of a web slitting mechanism, with parts omitted, diagrammatically indicating the slitting of a length of paper.

As shown in FIG. 1, the roll 25 of kraft paper or other suitable paper, such as recycled paper, is rotatably supported so a continuous web 24 of the paper can be drawn from the roll and formed into coils. The web has a width sufficient to be cut into several strips to form several coils simultaneously, as shown in FIG. 5. While the web shown in FIG. 5 illustrates seven strips side-by-side, that is by way of a preferred example only and the number may vary depending upon the production desired.

Figure 3:
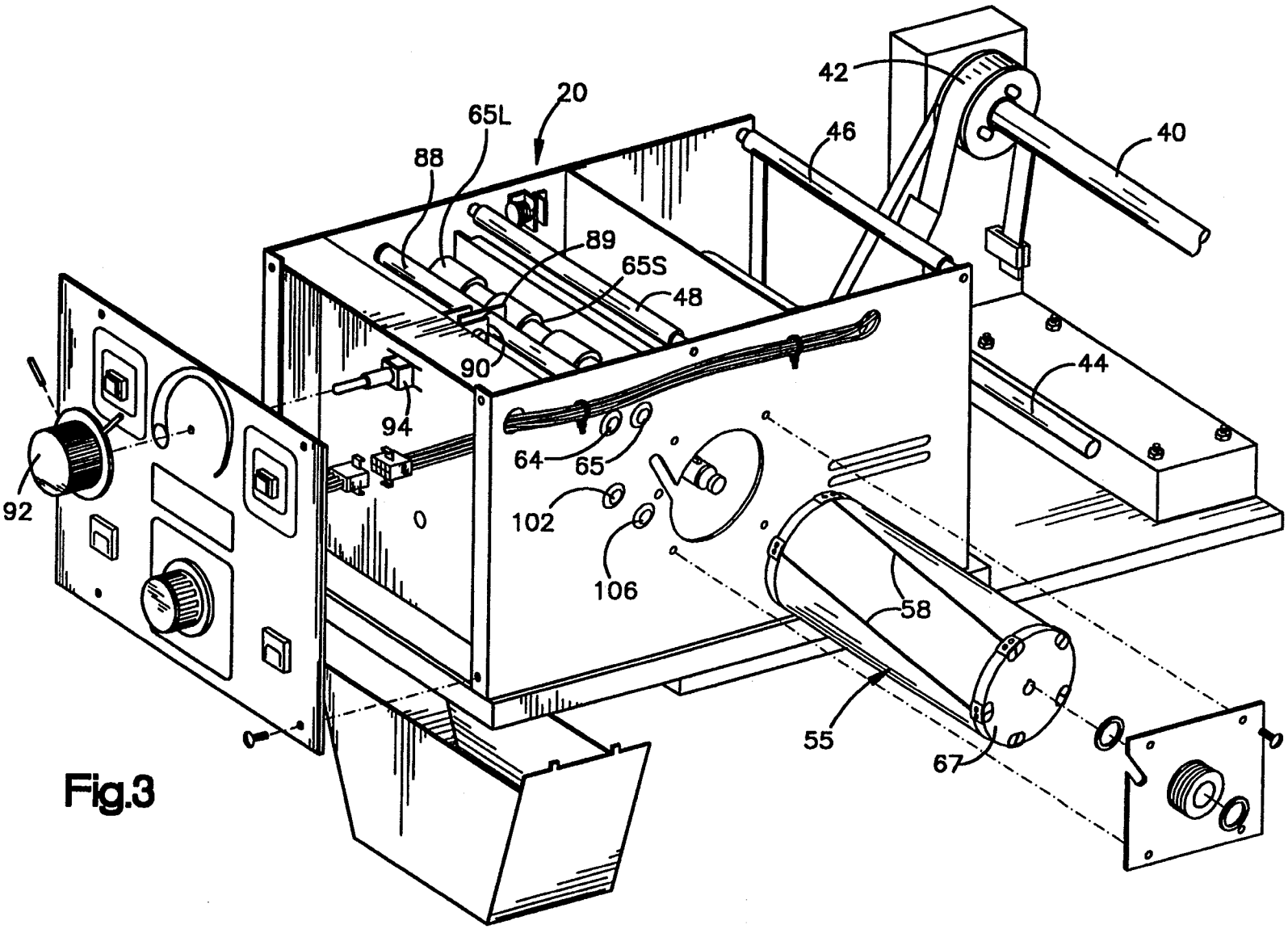
FIG. 3 is a diagrammatic exploded view of apparatus for forming the coils in accordance with the invention.
Figure 4:
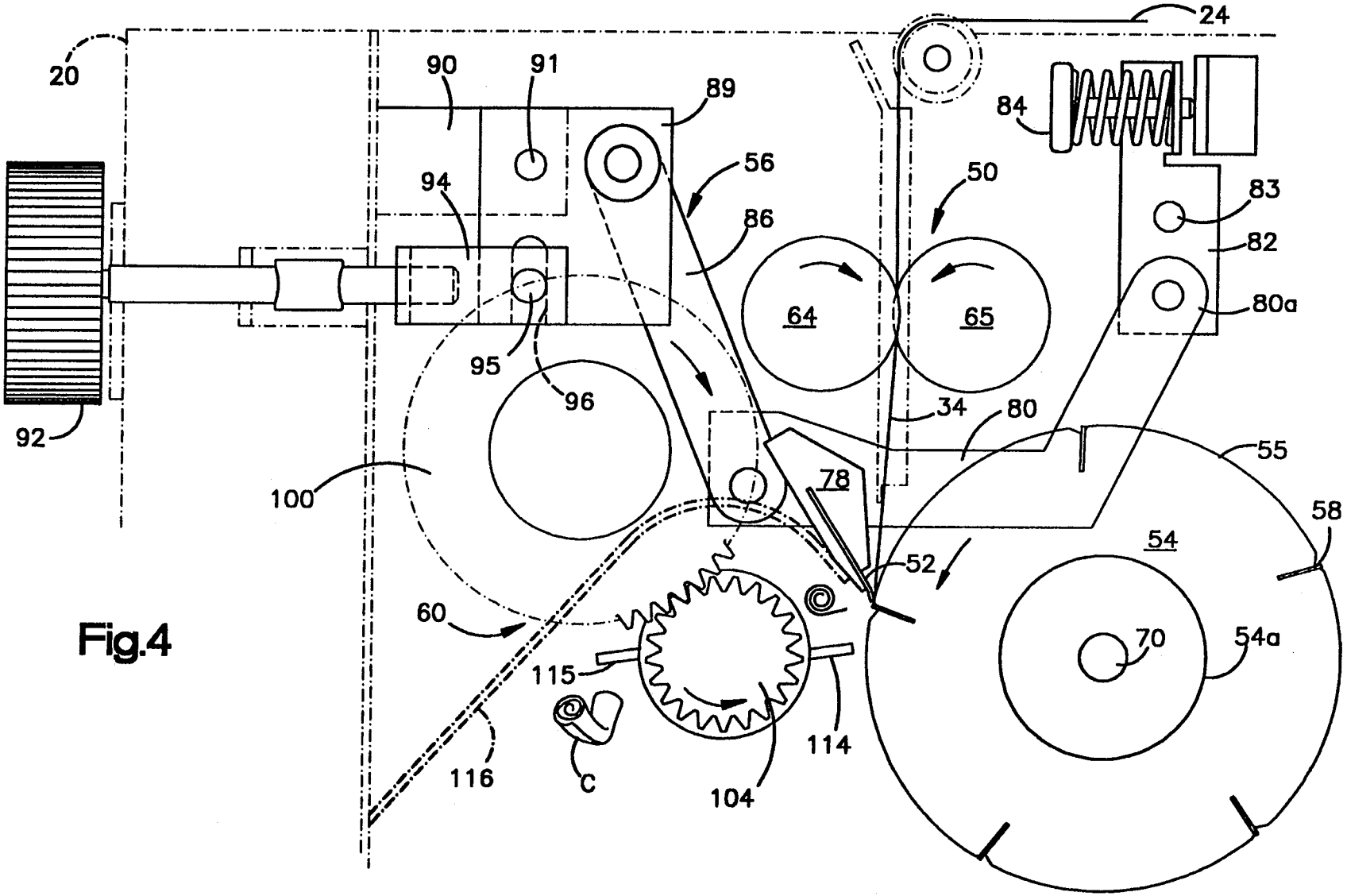
FIG. 4 is a diagrammatic side elevational view of apparatus for forming the coils in accordance with the invention.

The general construction and arrangement of the machine is best understood from FIGS. 3 and 4. The paper roll 25 is supported on a rotatable mandrel 40 and rotation is controlled by a brake 42 operated by an unwind dancer arm 44 under which the web 24 travels so the web is maintained under tension. The web is trained over a roller 46, travels across to and over a roller 48 and downward between a slitter mechanism 50 illustrated in more detail in FIG. 5, and then between a straight convex edge 51 of a forming blade 52 and a resilient forming roller 54 that has a peripheral surface 55 of higher coefficient of friction than the forming blade edge.

The forming blade is supported by an adjustable mounting mechanism 56 and once the paper strips are introduced between the forming blade and the forming roller the blade is pressed against the paper strips and into the forming roller peripheral surface sufficiently to indent the roller. Rotation of the roller 54 draws the web 24 from the paper roll 25, and in cooperation with the forming blade modifies the paper strips to cause them to curl in one direction and form spiral coils on the downstream side of the forming blade as illustrated in FIG. 4.

Cutting blades 58, five of which are used in the embodiment shown, are partially embedded in and extend across the width of the forming roller. These blades act against the forming blade 52 to sever coiled portions of the strips 34. Thus, the forming roller serves to feed the web, modify the paper strips to form coils, and sever the coils from the strips. The length of the severed portions of the strips is determined by the peripheral spacing of the blades, and the tightness and hence the diameter of the coils is determined by the force and degree of indentation between the forming blade edge and the forming roller peripheral surface.

Figure 14:
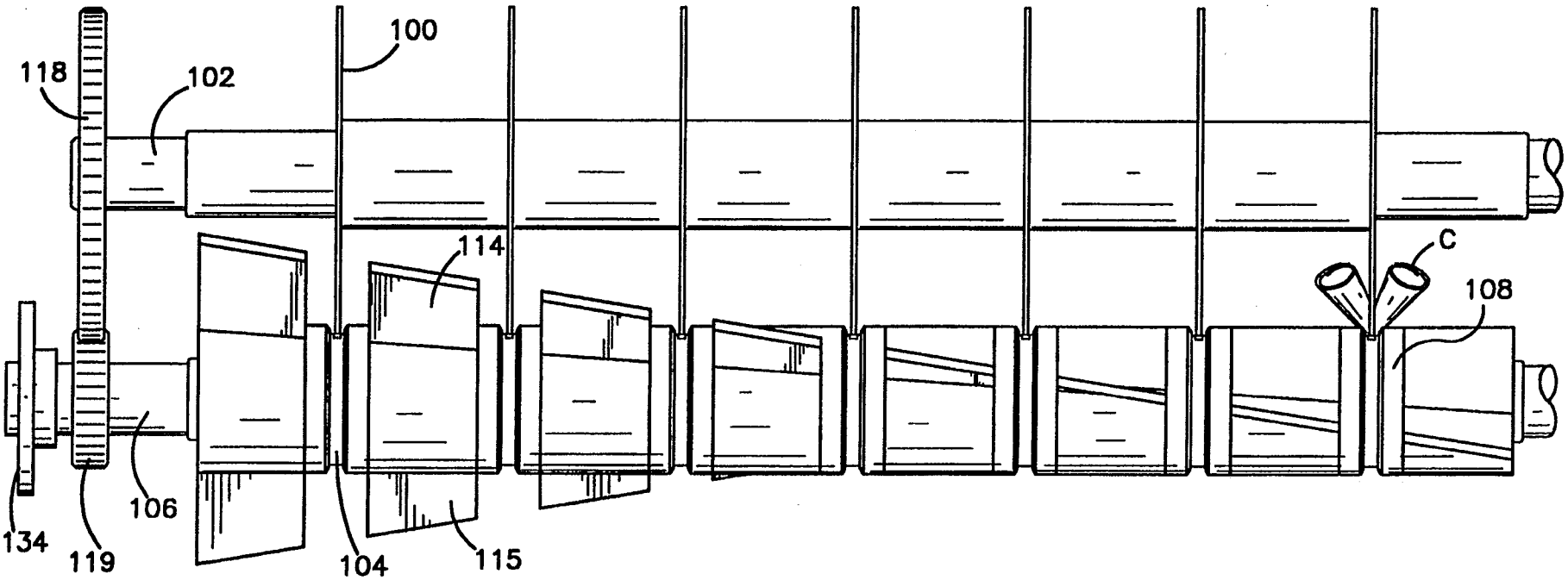
FIG. 14 is a front elevational view of a creasing mechanism of the apparatus for creasing coiled paper strips.
Figure 15:
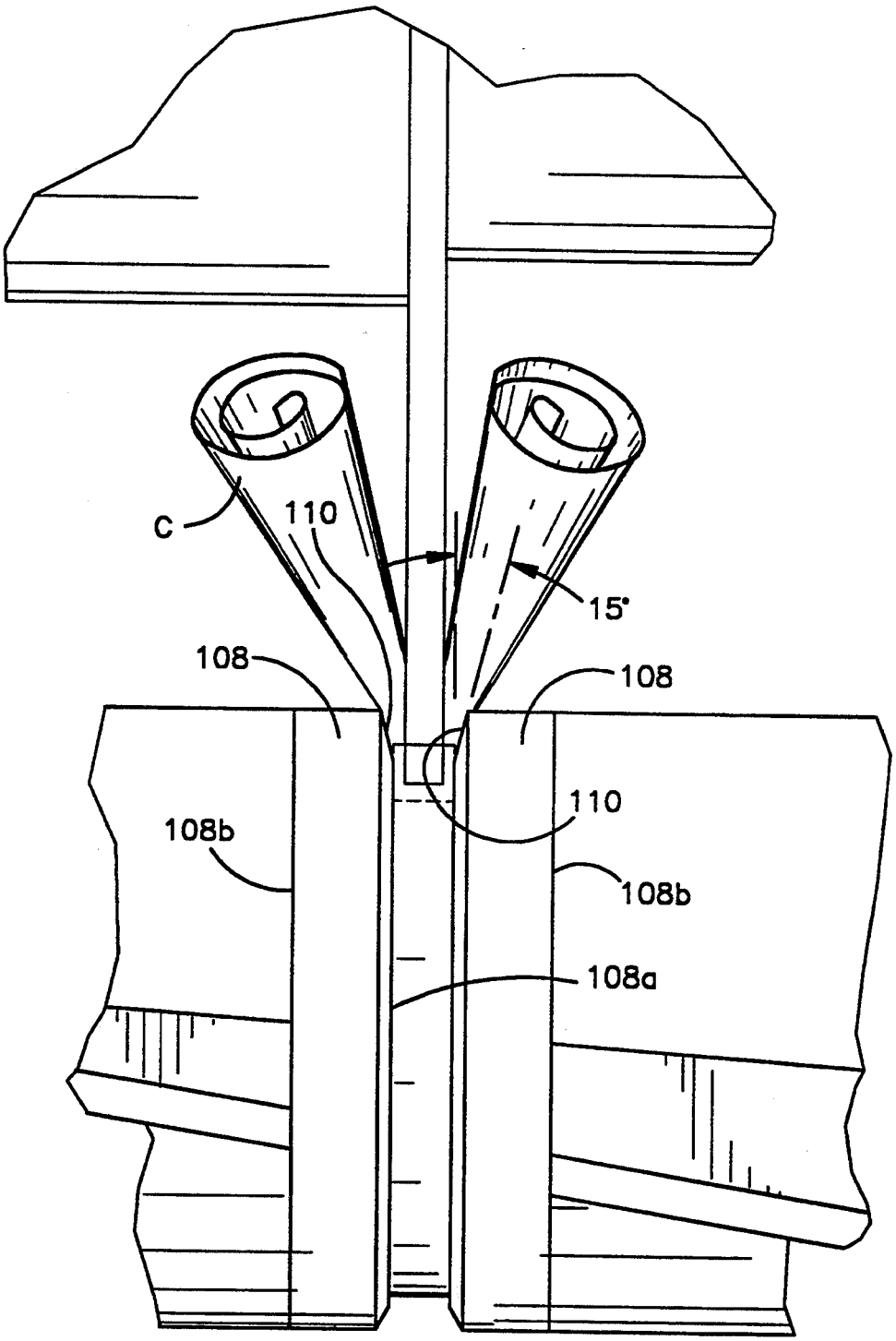
FIG. 15 is an enlarged partial view of the apparatus of FIG. 14.

The preferred embodiment of the invention has a creasing mechanism 60 shown in more detail in FIGS. 14 and 15 that receives the severed coils C and forms a transverse crease 37 between the ends of the coils. Transporters in the form of paddles or brushes 62 forming a part of the creasing mechanism serve to positively feed the coils to transversely spaced rotary opposed surfaces of the creasing mechanism through which the coils pass as they are creased or folded.

In the preferred embodiment shown, the web 24 is 12 inches wide and is cut into seven strips of equal width by the slitter mechanism 50 as the web is drawn from the roll 25 by the forming roller 54 and moved between two driven slitter rolls 64, 65 that slit the web into strips 34 extending in the direction of web travel. As shown in FIG. 5, the rolls have alternating larger and smaller diameter portions (shown at 64L and 64S on roll 64), each equal in width to the width of the strips to be cut. The larger diameter portions of each roll nest with the smaller diameter portions of the other with a small clearance and shear the web at the junctures to form strips as the web is pulled through the nip of the rolls. The nested larger and smaller portions of the rolls are spaced peripherally to provide a gap through which the web strips formed by the slitter mechanism pass.

Figure 10:
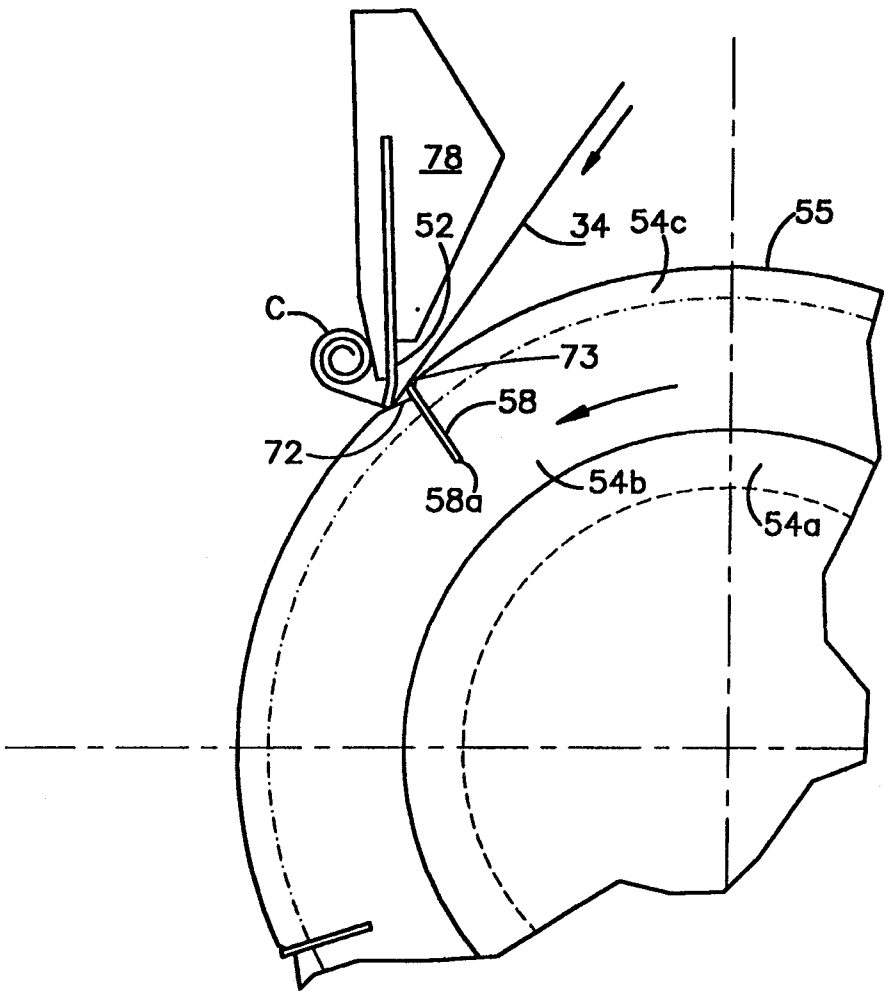
FIGS. 10–13 are diagrammatic partial side elevational views of the forming roller and a forming blade, illustrating the manner in which strips are modified to form spiral coils and cut by cutter blades embedded in the roller.

The strips formed from the web travel through a nip between the driven forming roller 54 and the narrow edge 51 of the adjustably fixed rigid forming blade 52. The driven roller and the blade extend the width of the web 24. The roller has an aluminum core 54*a*, to which end plates 67, 68 are secured and keyed to a driven supporting shaft 70. The core carries two layers 54*b*, 54*c* of urethane, as illustrated in FIG. 10. The layer 54*b* directly surrounds the core 54*a* and is relatively hard, having a durometer of 80 in the preferred embodiment. The layer 54*c* has a smaller depth than the layer 54*b*, forms the peripheral surface 55, and is relatively soft and resilient, having a durometer of 46 in the preferred embodiment.

Five cutting blades 58 are partially embedded in the roller 54 equally spaced about the periphery, extending across the width of the roller and extending slightly beyond the opposite ends. The cutting blades are helically oriented at an angle of 12 degrees to the axis of the roller, extend through the urethane layer 54*c* and into the layer 54*b*, terminating short of the aluminum core. Each cutting blade is inclined 7 degrees from a radial plane of the roller to provide a back rake such that an inner embedded edge 58*a* will move past the location of the stationary forming edge ahead of an outer edge 58*b* as the roller is rotated by the supporting shaft 70.

The blades are frictionally held within grooves cut into the urethane layers and the higher durometer layer 54*b* provides a firm support that substantially prevents radially inward movement of the blades. The resilience of the urethane layers, and particularly the more flexible outer layer 54*c*, and the laid back angle of the blades, allows the outer portions of the blades to move in a peripheral direction as they force the paper strips against the stationary forming blade 52 and sever the coiled portions.

Figure 9:
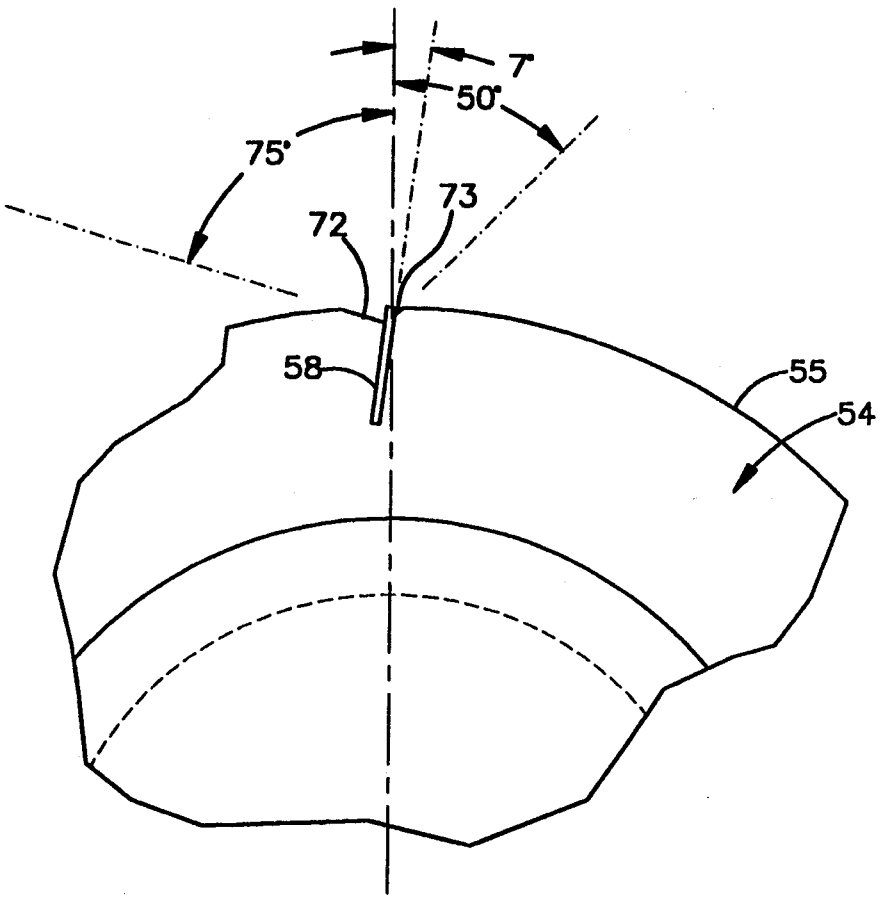
FIG. 9 is an enlarged partial side elevational view of the roller of FIG. 7, with an end plate removed to show the construction of the roller and a cutting blade.

As best shown in FIG. 9, the roller peripheral surface 55 has a chamfer or groove 72 along the leading side of each blade 58 and a smaller chamfer or groove 73 along the trailing side so a portion of each blade at the outer edge 58*b* is exposed to facilitate severing the coiled portions of the paper strips. In the preferred embodiment, the chamfer 72 forms an angle of 75 degrees with a radial plane of the roller and is 0.045 inch deep. The chamfer 73 forms an angle of 50 degrees with a radial plane of the roller and is 0.045 inch deep. The blade edge 58*b* is slightly recessed by a few thousandths of an inch (0.005 in the preferred embodiment) from the peripheral surface 55 but exposed due to the groove formed by the chamfers.

Figure 8:
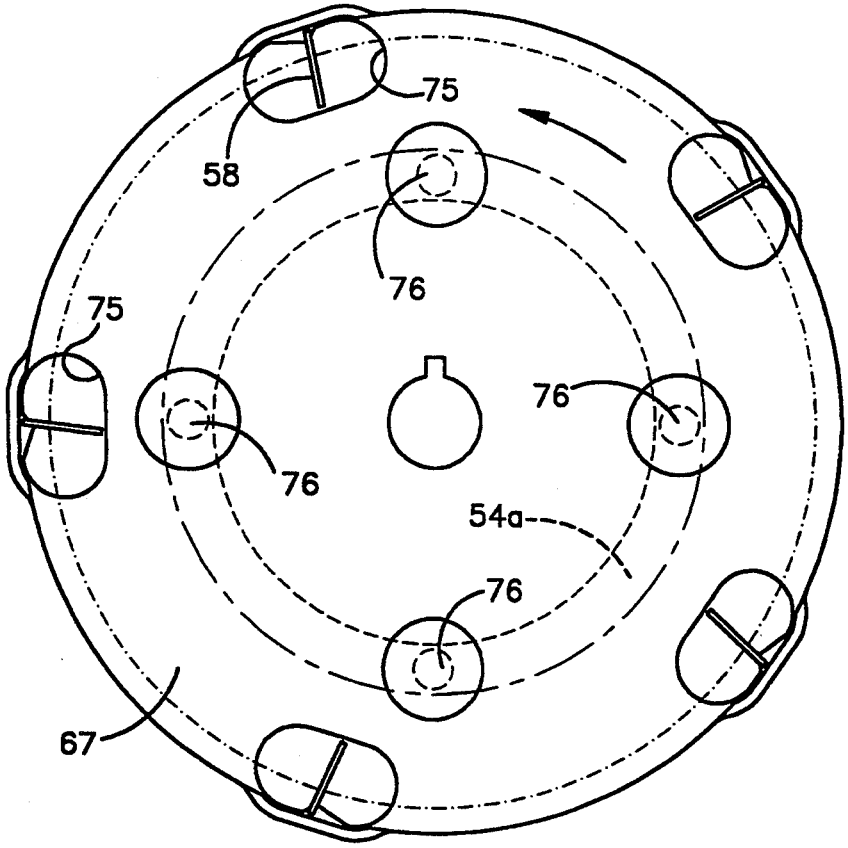
FIG. 8 is a side elevational view of the roller of FIG. 7 as viewed from the plane of line 8—8.

The end plates 67, 68, as best shown in FIG. 8, have apertures 75, one for each blade, adjacent the periphery of the plates. These apertures receive an end portion of each cutting blade that extends beyond the opposite ends of the forming roller 54, and retain the blades in proper location within the urethane layers while allowing for peripheral movement of the outer edge 58*b*. In addition, the end plates, which are secured to the core 54*a* by four screws 76, transmit rotation to the roller from the supporting shaft 70.

The support mechanism 56 for the forming blade 52 is best shown in FIG. 4. The blade is supported by and extends from a support plate 78 that is secured to arms 80 of generally L-shaped construction at opposite ends of the support plate. One end 80*a* of each arm 80 is pivoted to a support block 82 that is supported on the apparatus housing by a pivot 83 and is adjustable about the pivot by a screw 84 to establish a desired orientation of the arms. A second pair of arms 86, one at each end of the the support plate, pivotally connect an opposite end 80*b* of each arm 80 to a cross rod 88 (see also FIG. 3) supported centrally along its length by a plate 89 received between two spaced support tabs 90 fixed to the front of the housing and pivoted relative to the tabs on a cross pin 91. The plate 89 is pivoted by a knob and screw 92 mounted on the housing. The screw drives a yoke 94 that has a cross pin 95 received in a slot 96 of the plate 89. By rotating the knob and screw 92, the forming blade can be moved into the surface of the forming roller to the desired extent, changing the force applied to the paper strips.

The roller surface 55 deforms inwardly when the strips 34 are pressed against it by the narrow edge 51 of the forming blade 52. The narrow blade edge is preferably smooth so as not to cut the strips during the forming operation and is rounded to facilitate travel of the strips across the edge as they are moved by the friction between the roller and the paper. The surface of the strips against the blade is believed to be compressed, while the surface against the roller is believed to be stretched and substantially permanently expanded as it is bent over the edge of the blade by the deformation of the roller and is frictionally moved by the indented roller surface. The amount of force applied to the strips and the extent to which the blade and strips indent the roller surface can be varied by the knob and screw 92. A greater force causes a greater modification of the strip structure and causes the strips to curl to a greater extent. Thus the diameter and hence the density of the resulting coils can be readily controlled. This makes for a convenient way to control the cushioning characteristics of the dunnage to match the needs of the articles being packaged.

Figure 13:
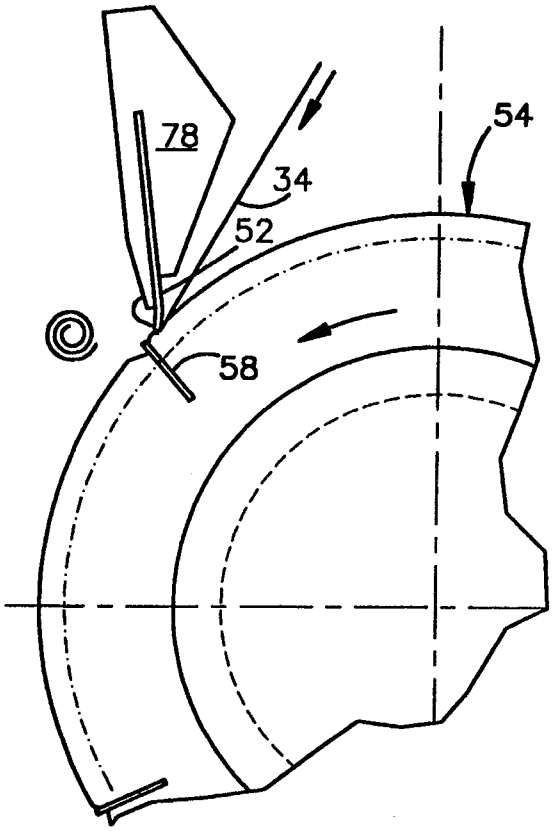
Figure 12:
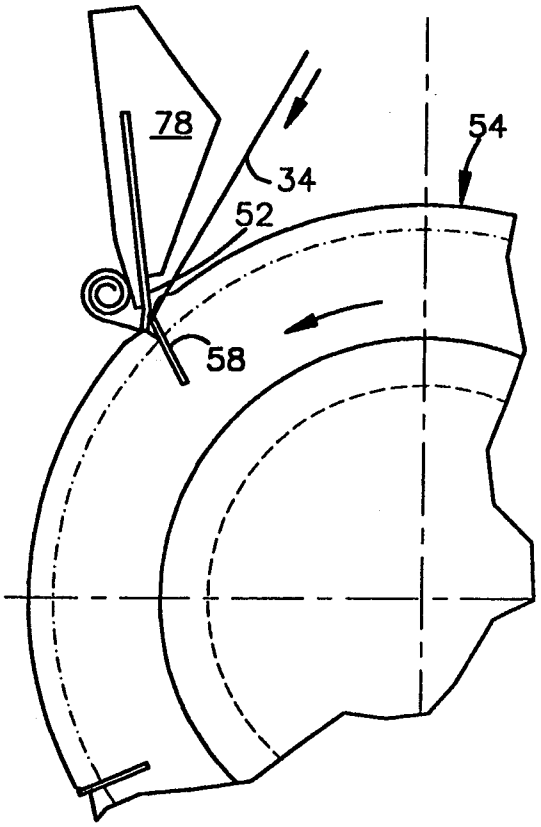
Figure 11:
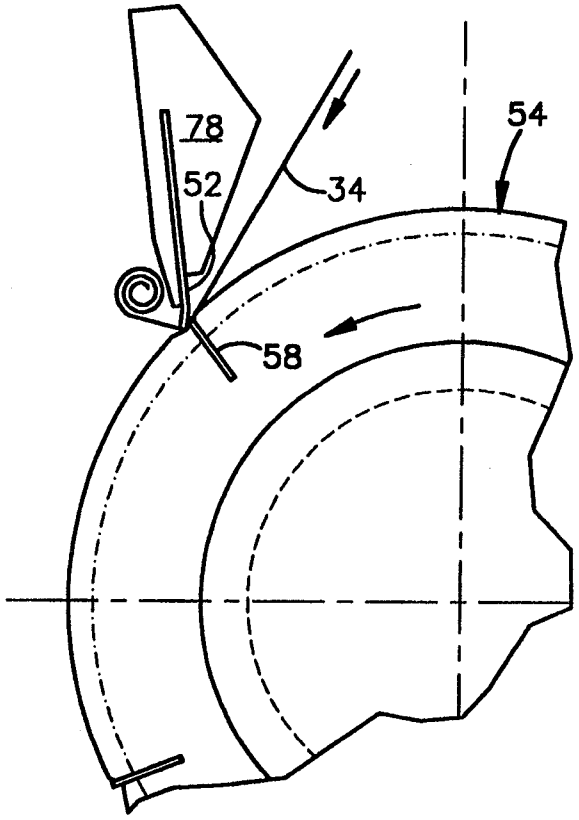

The manner in which the cutting blades 58 cooperate with the forming blade 52 to sever coils from the strips of paper while maintaining continuity of feeding and forming successive portions of the continuously slit web is best illustrated in FIGS. 10–13. As shown in FIG. 10, the strips coil behind the forming blade as the forming roller rotates in the direction of the arrow. As a cutting blade 58 approaches the forming blade (FIG. 11), the blade, which was indenting the cylindrical peripheral surface 55, follows the chamfer 72 and the strip 34 is pinched between the exposed edge **58*b* of the cutting blade and the surface of the forming blade just above the forming edge. The forming blade causes the cutting blade (FIG. 12) to move back and up, deforming the urethane layers and severing the coiled portion of the strip. It is believed that the deformed portion of the urethane engages the not yet curled portion of the strip and carries it beneath the forming edge as the surface returns to its original shape, maintaining continuity of feed, as shown in FIG. 13**. Because of the angle at which the cutting blades are oriented relative to the axis of the forming roller, the strips are cut in sequence from one end of the roller to the other. By virtue of the construction and arrangement of the cutting blades and chamfers, the cutting operation is achieved with relatively low impact and noise levels.

The creasing mechanism is best shown in FIGS. 4, 14 and 15. Spaced circular discs 100 are supported on a rotary driven shaft 102 that extends transversely of the path of web travel and parallel to the axis of the forming roller. The discs are equal in number to the number of strips 34 and are spaced apart along the shaft a distance equal to the width of the strips, but located relative to the forming roll to engage coils midway between the ends. Spaced circular discs 104 smaller in diameter than the discs 100 are supported on a rotary driven shaft 106 that is parallel to the shaft 102 and adjacent to the forming roller and forming blade, slightly below and offset from the forming blade. The discs 104 are located to directly oppose the discs 100. In the preferred embodiment, the opposed discs have serrated or toothed peripheries similar in contour to the teeth of a chain wheel and the peripheries of opposed discs partially mesh, in a manner similar to gear teeth but with greater clearance. This construction serves to form a crease that retains its form in the coils.

The discs 104 are slightly wider than the discs 100 and are bounded on opposite sides by washers 108 of slightly larger diameter than the discs 104. A radial surface **108*a* of each washer faces the adjacent disc and has a bevel 110 of 15 degrees at the outer periphery that extends to the outside periphery of the discs 104 to provide space for a coil to be creased or folded and to partially fold the coil portions on opposite sides of the crease toward each other. Spacer spools 112 extend between the radial surfaces 108*b* of adjacent washers and have the same diameter as the washers. The spools have diametrically opposed extending paddles 114, 115 that can be of solid construction, e.g., molded with the spools, or can be in the form of bristles or other material sufficiently stiff to extend in cantilevered fashion from the spools and intercept and carry formed coils into the bight between opposed discs 100, 104**.

As shown in FIG. 4, the paddles extend to a location closely adjacent the periphery of the forming roller 54, where they catch formed coils as the coils are severed from the paper strips. The paddles are partially enclosed by a deflector 116 located between each successive disc 100. Each deflector and spool forms a confined passage for the coil picked up by a paddle. The passage directs the coil into the bight between opposed pairs of discs 100, 104, where the coil is creased, as illustrated in FIG. 15, by the rotating discs and ejected from the apparatus, typically directly into a container that forms a package.

As shown in FIG. 14, successive paddles 114, 115 are at a progressively advanced peripheral location about the shaft 106, forming a helix of the same angular relationship with the shaft axis as the cutting blades 58 form with the forming roller axis so the paddles are coordinated in their rotation with the portion of the cutting blades that act on the paper strip aligned with an adjacent disc so as to catch each coil soon enough after it is severed to engage it and move it through the creasing discs. The helical angle is exaggerated in FIG. 14 for purposes of illustration.

The two shafts 102, 106 are geared together. The shaft 102 carries a gear 118 and the shaft 106 carries a meshing gear 119. Each gear is equal in diameter to the discs on the respective shaft and the speed of rotation is established so a paddle 114, 115 arrives adjacent the forming blade each time a cutting blade severs a coil.

Figure 6:
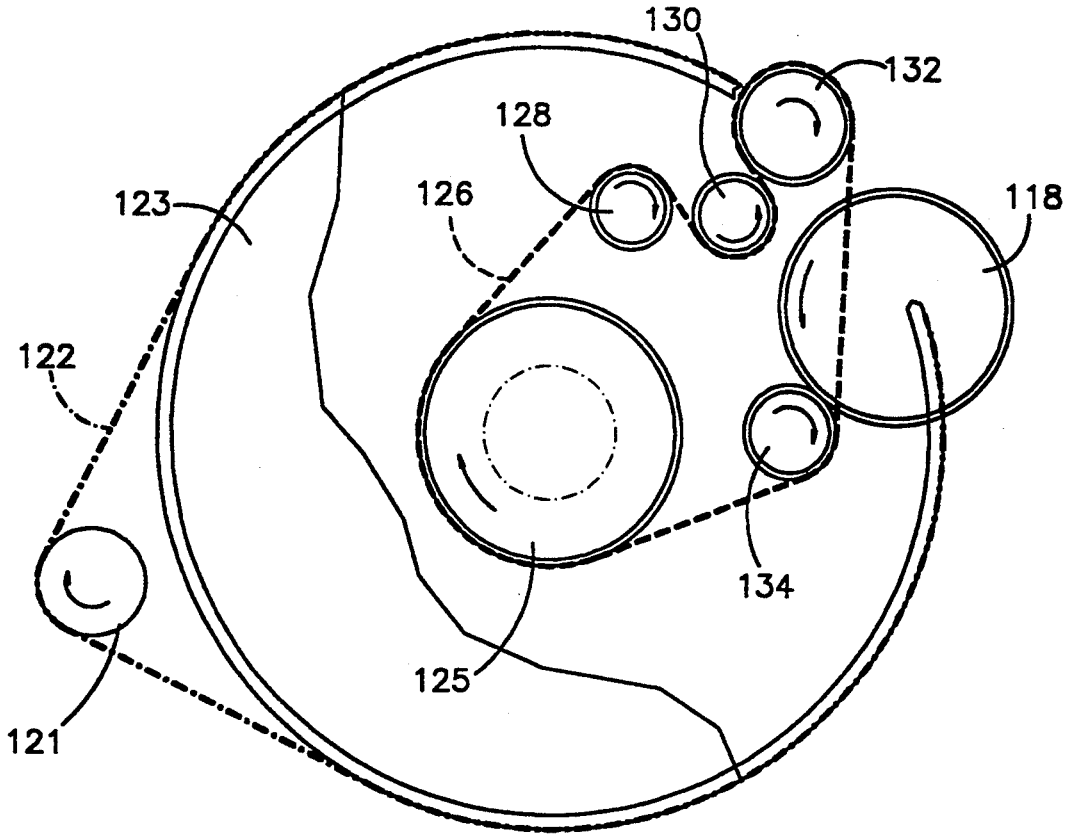
FIG. 6 is a diagrammatic side elevational view as seen from the far side of the apparatus of FIG. 1, illustrating the drive train for various rotary elements of the apparatus.

Coordinated operation of the various components is provided by the drive train shown in FIG. 6. A drive chain wheel 121 is attached to a motor shaft (not shown) and through a main chain drive 122 rotates a large chain wheel 123 that drives the shaft 70 of the forming roller 54. A smaller sprocket 125 that rotates with the large chain wheel 123 drives a second chain 126 that extends over a sprocket 128 on the slitter shaft 64, and extends under a sprocket 130 on the slitter shaft 65 to drive them at equal speeds but in opposite directions, and then over a tension sprocket 132, and finally over a sprocket 134 on one end of the shaft 106 that supports the smaller creasing discs and paddles.

While the invention has been described with particularity, it will be appreciated that many variations and alterations may be made or features added, without departing from the spirit and scope of the invention set forth in the claims. For example, while paper is the preferred material because of the low cost and biodegradable properties and its ability to be recycled, as well as its inherent resilient qualities, other thin, flexible, resilient materials can be formed into coils using the apparatus and methods disclosed herein and will function in a similar manner, and provide dunnage that will protect articles in containers and can be produced at the time and place the articles are packaged so as to eliminate bulky storage. It is believed that thin, flexible, resilient plastic sheets or webs, metal foils with proper temper, or laminates of plastic, metal foils and/or paper can be used.

I claim:

1. Apparatus for concurrently forming a plurality of coils of thin, flexible, resilient strips of material. comprising:

means defining a path along which a length of thin, flexible resilient material wider than individual coils to be formed is moved, cutters in said path for separating the length into strips that form separate coils, a cylindrical roller rotatably supported across said path and having a resilient peripheral surface over which said material is moved, a stationary, rigid, member having a convex and narrow edge supported across said path, located to act against said material and said roller with force sufficient to indent the roller surface, for bending and tensioning said material across said edge, said edge having a lower coefficient of friction than said surface, a cutting element partially recessed in and extending along the width of the roller and across said path, and partially exposed at the peripheral surface of the roller, constructed and arranged to coact with said member to sever said material in a direction transverse to said path, and a drive for rotating said roller about a central axis relative to said member to feed said material past said edge.

2. Apparatus as set forth in claim 1 wherein said cutting element extends across the roller at an acute angle to the axis of the roller.

3. Apparatus as set forth in claim 2 wherein the cutting element is a blade embedded in a slot in the surface of the roller, and the blade and slot are located in a non-radial plane relative to the roller axis.

4. Apparatus as set forth in claim 3 wherein the blade and slot are inclined from a radial plane of the roller such that an inner embedded edge of the blade is moved past the location of the stationary edge ahead of the extending edge as the roller is rotated to feed the material past the stationary member.

5. Apparatus as set forth in claim 4 wherein the peripheral surface of the roller is recessed along opposite sides of the blade.

6. Apparatus as set forth in any one of claims 3–5 wherein the roll is sufficiently resilient to the depth to which the blade is embedded to allow the blade to move in a peripheral direction relative to the roller as it moves past the stationary member.

7. Apparatus as set forth in claim 6 wherein the roller is sufficiently rigid at a depth to which the blade is embedded to substantially prevent radially inward movement of the blade as it moves past the stationary member.

8. Apparatus as set forth in any one of claims 1–4, including means in said path for creasing coils formed from the strips.

9. Apparatus as set forth in claim 8 wherein said means includes rotary discs spaced transversely of the path.

10. Apparatus as set forth in claim 8 including rotary ejectors adjacent said creasing means to engage formed coils and move them into engagement with said creasing means.

11. Apparatus as set forth in claim 8 wherein said means includes opposed pairs of rotary surfaces spaced across said path means to rotatably drive at least one surface each pair, and including rotary projections between said spaced pairs for engaging coils formed from the strips and moving them into engagement with the rotary surface.

12. Apparatus for concurrently forming a plurality of spiral coils of thin flexible paper, having multiple convolutions, comprising:

means establishing a path along which a length of thin flexible paper can be moved, means for cutting a length of paper in the direction of movement along the path to form strips, a narrow rigid convex surface supported to extend across said path, means, including a resilient roller and partially recessed peripherally spaced cutting blades carried by the roller, for continuously feeding the paper along said path and across said surface, and for continuously bending the paper against, and moving it through engagement across, said surface with sufficient force and pressure to stretch one side of the paper relative to an opposite side and to cause the paper to curl in a single direction sufficiently to form spiral coils of plural convolutions, and for coacting with said stationary surface for periodically cutting said paper to separate the coiled portions, and means to rotatably drive said roller.

13. Apparatus as set forth in claim 12 including means for transversely creasing coils formed from the strips.

14. Apparatus as set forth in claim 13 wherein said creasing means includes rotary discs spaced transversely of the path for engaging the coils and forming a transverse crease in the coils 15. Apparatus as set forth in claim 14 wherein the rotary discs coact with opposed rotary surfaces, said discs and each having opposed surfaces being serrated.

16. A method for concurrently forming a plurality of spiral coils of paper having plural convolutions, comprising:

providing a length of paper wider than the width of individual coils to be formed, continuously cutting the length of paper along the direction of feed to form adjacent strips, continuously moving the paper across a single narrow, rigid, surface with a driven roller having a resilient surface, bending and tensioning the length of paper across said surface with sufficient force to cause the length of paper to coil in a single direction into multiple convolutions, and periodically cutting the length of paper across its width by carrying a blade with said roller and moving the blade across said surface to pinch the paper between said surface and said blade.

17. A method as set forth in claim 16 including the step of creasing coils formed from the strips transversely between ends of the coils.

* * * * *